US006227845B1

(12) United States Patent
Pillow et al.

(10) Patent No.: US 6,227,845 B1
(45) Date of Patent: May 8, 2001

(54) TORCH HOLDER

(76) Inventors: Thomas M. Pillow; Richard F. Pillow, both of 14905 Owls Nest Rd., Nokesville, VA (US) 20181-1412

( * ) Notice: Subject to any disclaimer, the term of this patent is extended or adjusted under 35 U.S.C. 154(b) by 0 days.

(21) Appl. No.: 09/592,658

(22) Filed: Jun. 13, 2000

(51) Int. Cl.[7] ..... F23D 11/36

(52) U.S. Cl. ..... 431/343; 431/345; 248/156; 248/530; 362/159

(58) Field of Search ..... 431/343, 344, 431/320, 291, 295, 146, 345; 126/29, 30, 45, 47; 248/156, 545, 530; 362/159, 161, 266, 392, 431, 382, 249; D26/8

(56) References Cited

U.S. PATENT DOCUMENTS

| | | | |
|---|---|---|---|
| 1,002,260 | 9/1911 | Golden | 248/545 |
| 1,452,640 | 4/1923 | Hulick | 126/30 |
| 2,625,985 | 1/1953 | Morgan et al. | 248/156 |
| 4,453,204 | 6/1984 | Warshawsky | 362/396 |
| 4,938,446 | 7/1990 | Williams | 248/530 |
| 5,205,730 | 4/1993 | Capdeville | 431/320 |
| 5,390,884 | 2/1995 | Skoff et al. | 248/156 |
| 5,938,430 | 8/1999 | Majerowski | 431/343 |

*Primary Examiner*—James C. Yeung
(74) *Attorney, Agent, or Firm*—Reed Smith Hazel & Thomas LLP

(57) ABSTRACT

A torch holder includes a supporting portion, a receiving portion and a engaging portion. The supporting portion includes an L-shaped upper portion and a lower portion with one end connected to the upper portion and the other end inserted into the ground. The engaging portion is also an L-shape and so positioned that both L-shaped structures are in the same plane to keep the holder from rotating and fixed in the vertical position. The receiving portion is mounted on the upper portion of the supporting portion, which includes a cylindrical holding portion mounted on the supporting portion with a screw or the like for securing the torch in a cylindrical holding portion.

7 Claims, 1 Drawing Sheet

TORCH HOLDER

BACKGROUND OF THE INVENTION

I. Field of the Invention

The present invention relates in general, to supporting a torch, and in particular, to supporting a torch in an outdoor environment. The present invention includes a supporting portion, a receiving portion and an engaging portion.

This invention addresses a need to facilitate the placement and use of torches in a backyard or picnic area setting so that the torch is rigidly supported in a vertical manner and easily removable.

II. Discussion of the Related Art

Existing torch holders are not satisfactory because known torch holders are attached to a chair, table, tree or other fixed object, such that the flame of the torch is in close proximity to some flammable property or to human beings.

To keep a torch away from other objects at an outdoor event, the present invention requires a torch to be supported by a torch holder inserted into the ground so that the torch holder is then free standing away from human beings and valuable or flammable property.

Other designs of free standing holders, or the like, have been provided for achieving supporting results, such as those shown in U.S. Pat. No. 2,426,443 to Fetterman entitled "Support and Brace Thereof", U.S. Pat. No. 4,938,446 to Williams, entitled "Fishing Rod Support", U.S. Pat. No. 5,067,683 to Wagner, entitled "Portable Target Holder", or U.S. Pat. No. 5,375,801 to Porter, entitled "Temporary Sign Post". These designs have certain disadvantages such that the holders are provided with either less than sufficient support or burdensome features in terms of weight and manufacturing cost for holding a torch.

In addition, the prior art references do not show or teach an easy adjustment to torches with a diameter bigger than average. There is therefore a need in the art for effective, safe, and easy to adjust torch holders.

BRIEF DESCRIPTION OF THE DRAWINGS

The foregoing features and advantages of the invention will become apparent from the following more particular description of preferred embodiments of the invention, as illustrated in the accompanying drawings, in which.

DESCRIPTION OF THE PREFERRED EMBODIMENT

In order to more clearly and concisely describe the subject matter of the claims, the following definitions are intended to provide guidance as to the meanings of specific terms used in the following written description. Also it is to be understood that the phraseology or terminology employed herein is for the purpose of description and not of limitation. As used herein:

"Torch" includes all forms of portable light produced by the flame of a stick of resinous wood or of a flammable material wound about the end of a stick of wood (The American Heritage® Dictionary of the English Language, Third Edition copyright© 1992 by Houghton Mifflin Company).

"A predetermined size" of the torch means the predetermined diameter of torches available on the market. Consequentially, the diameter of the cylindrical holding portion of the present invention will depend on the predetermined size" of the torch to be held and the elasticity of material from which the cylindrical holding portion is made.

Figure 1:
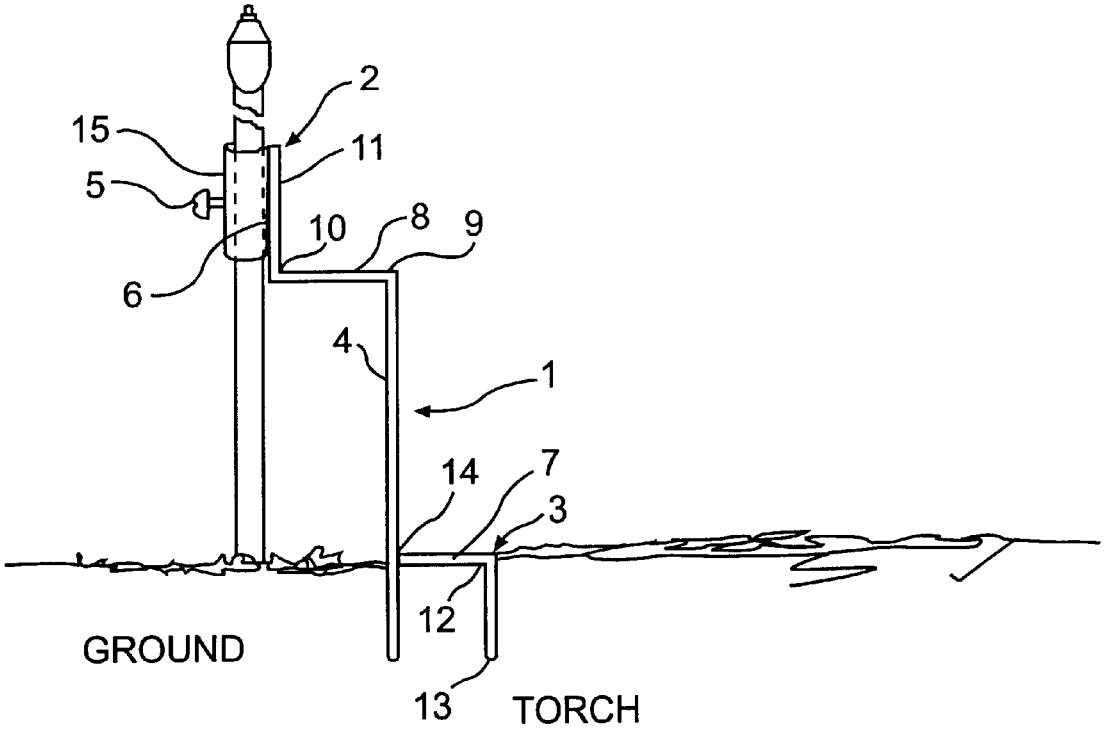
FIG. 1 is a perspective view of an embodiment of the invention as it is holding a torch.
Figure 2:
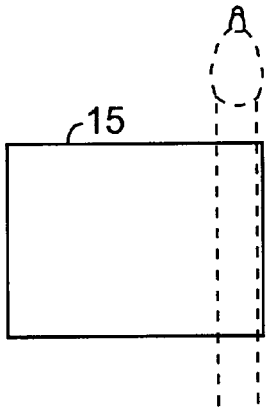
FIG. 2 is a perspective view of an embodiment of the cylindrical holding portion is made from an elastic material.
Figure 3:
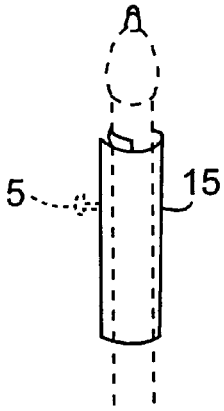
FIG. 3 is a perspective view of the cylindrical holding portion in FIG. 2 when curved around a torch so as to adopt to said diameter of said torch.

In brief overview, and referring to FIG. 1, a torch holder of the present invention The supporting portion 1 includes an L-shaped upper portion 9 of suitable dimensions so bent that angle 10 formed between arm 8 and arm 11 is 90 degrees, and a lower portion 4 with one end connected to arm 8 and the other end inserted into the ground.

The engaging portion 3 is L-shaped with 90° angle 12 between arm 7 and arm 13. Arm 7 is connected to supporting portion 1 at point 14 so that the length from the point 14 to the end of the lower portion 4 is substantially the same as the length of arm 13. Arm 11, arm 13 and lower portion 4 are generally parallel to one another, and arm 7 and arm 8 are perpendicular to arm 11 and arm 13 respectively. As a result, both L-shaped structures are in the same plane so that the holder will be prevented from rotating and kept fixed in the vertical position.

The receiving portion 2 is mounted on the upper portion 9 of the supporting portion 1, which includes a cylindrical holding portion 15 mounted on the supporting portion 1 at a contacting area 6, and a ¼-20 screw 5 for securing the torch in cylindrical holding portion 15. The screw 5 may further secure the torch by penetrating through the torch.

Easy insertion of the torch holder into the ground is accomplished by stepping on arm 7 while holding the entire holder vertically, then pressing arm 13 and the end of lower portion 4 into the ground until arm 7 is flush with the ground. Both arm 13 and the end of lower portion 4 are designed with tapered points for easier insertion. Removal of the torch holder from the ground is accomplished by lifting up on arm 8 until the device is freed from the ground.

In anther embodiment, the cylindrical holding portion 15 is made from an elastic material, such as rubber or plastic, so that it is circumferentially expandable to adapt to the diameter of a torch. In a third embodiment, the cylindrical holding portion 15 is made from a sheet of metal or other materials which could be curved into a cylindrical shape around a torch with a diameter bigger than a predetermined size.

What is claimed is:

1. A torch holder for holding a torch generally perpendicularly to a ground surface, comprising:

a supporting means having an upper portion and a lower portion, wherein said upper portion is generally L-shaped with one end integrated into said lower portion and the other end pointing generally against said ground, and said lower portion to be inserted into said ground;

a torch receiving means for receiving and attaching said torch to said supporting means, wherein said receiving means is mounted on said upper portion of said supporting means and comprises a cylindrical holding means and a securing means for securing said torch in said cylindrical holding means; and an engaging means for engaging said supporting means to the ground surface, which is integrated into said lower portion of said supporting means.

2. A torch holder as claimed in claim 1, wherein said engaging means is generally L-shaped with one end integrated into said lower portion of said supporting means and the other end to be inserted into said ground.

3. A torch holder as claimed in claim 1, wherein said securing means comprises at least one screw for drilling and tapping through said cylindrical holding means and said torch.

4. A torch holder as claimed in claim 3, wherein said screw further secures the torch by penetrating through the torch.

5. A torch holder as claimed in claim 1, wherein said cylindrical holding means is circumferentially expandable to adapt to a diameter of said torch.

6. A torch holder as claimed in claim 4, wherein said cylindrical holding means is made from a material selected from the group consisting of rubber and plastic.

7. A torch holder as claimed in claim 1, wherein the body of said cylindrical holding means comprises:

a circumferential rim portion with sufficient length to accommodate said torch with a diameter larger than a predetermined size; and a longitudinal rim portion formed to curve around said torch so as to adopt to said diameter of said torch.

* * * * *